United States Patent [19]

Vlad et al.

[11] 4,210,010

[45] Jul. 1, 1980

[54] COOLING ARRANGEMENT

[75] Inventors: Constantin Vlad, Nordassel; Hans Paulitsch, Bad Reichenhall, both of Fed. Rep. of Germany

[73] Assignee: Stahlwerke Peine-Salzgitter Aktiengesellschaft, Peine, Fed. Rep. of Germany

[21] Appl. No.: 1,890

[22] Filed: Jan. 8, 1979

[30] Foreign Application Priority Data

May 24, 1978 [DE] Fed. Rep. of Germany ..... 2822582

[51] Int. Cl.[2] ..... B21B 43/00; B21B 45/02

[52] U.S. Cl. ..... 72/201; 266/113

[58] Field of Search ..... 72/200, 201; 134/64 R, 134/82, 83, 122 R, 199; 148/153, 155, 156; 266/113

[56] References Cited

U.S. PATENT DOCUMENTS

| | | | |
|---|---|---|---|
| 1,211,277 | 1/1917 | Bloom | 266/113 X |
| 2,307,694 | 1/1943 | Malke | 134/122 R |
| 3,552,730 | 1/1971 | Kawecki | 148/153 X |
| 3,621,696 | 11/1971 | Norlindh | 72/201 |
| 3,687,145 | 8/1972 | Schrader et al. | 266/113 X |
| 3,895,139 | 7/1975 | Brown et al. | 148/156 X |
| 3,991,986 | 11/1976 | Ward et al. | 134/64 R X |
| 4,106,519 | 8/1978 | Jalil et al. | 134/122 R |
| 4,136,544 | 1/1979 | Masahiko | 72/201 |

FOREIGN PATENT DOCUMENTS

| | | | |
|---|---|---|---|
| 15299 | 7/1965 | Netherlands | 134/122 R |
| 386996 | 6/1973 | U.S.S.R. | 266/113 |
| 410844 | 1/1974 | U.S.S.R. | 72/201 |
| 566643 | 7/1977 | U.S.S.R. | 72/201 |

*Primary Examiner*—Ervin M. Combs
*Attorney, Agent, or Firm*—Michael J. Striker

[57] ABSTRACT

A cooling arrangement, especially but not exclusively suited for cooling rolled stock such as wires and bars, has two end members provided with axially aligned passages through which a workpiece can travel. The end members are connected by an annularly arranged series of bars between which spaces are left free so that cooling fluid admitted into contact with the workpiece can rapidly flow off again. The space surrounded by the bars converges in the direction of travel of the workpiece. Upstream of one end member is provided a fluid admitting element formed with a workpiece guide passage which is divergent-convergent as considered in the travel direction of the workpiece. A fluid inlet arrangement has an inner wall bounding the passage and provided with circumferentially spaced slot-shaped openings which communicate with the divergent part and extend toward the convergent part, and an outer wall surrounding the inner wall and bounding with the same an annular fluid chamber from which the slot-shaped openings receive fluid.

5 Claims, 6 Drawing Figures

COOLING ARRANGEMENT

BACKGROUND OF THE INVENTION

The present invention relates generally to a cooling arrangement.

More particularly, the invention relates to a cooling arrangement for rolled materials, such as wires, rods and the like.

On completion of the final rolling step these materials, especially wire, must be superficially cooled rapidly and repeatedly; such superficially cooling must be as uniform and intensive as possible over the entire surface area of the workpiece. Moreover, to obtain the desired effect it is necessary—as explained e.g., in U.S. Pat. No. 1,211,277—to remove the cooling fluid quickly after each superficially cooling step so that the heat at the core of the workpiece can quickly raise the temperature of the workpiece surface again.

To effect such superficially cooling it is known to use tubes through which the workpiece, such as wire, travels to be contacted in one tube section with a cooling fluid (e.g., water) which is rapidly withdrawn at another tube section. It is also known to arrange several such tubes one behind the other, to provide an installation in which the wire can be repeatedly superficially cooled and allowed to reheat (due to its core heat) in intermediate stations.

One problem with this known state of the art is that it is not well suited for the production of special high-quality wires, for example wires in which a core with fine-lamellar perlite and with an outer martensite layer of a specific thickness is to be produced. The known arrangements permit a rapid application of the cooling medium to the wire surface, but do not permit a rapid enough subsequent withdrawal of the cooling medium out of contact with the surface. This, however, is a major requirement when it is desired to produce certain steels of uniform high quality, since to obtain these it is necessary to subject the workpiece to rapid superficially cooling (to produce a maximum temperature difference between the workpiece core and the workpiece surface) and thereafter to assure equally rapid temperature equalization between the core and the workpiece surface due to reheating of the surface by the heat of the core.

In the known cooling arrangements the length of the path portion in which the workpiece is first contacted with cooling fluid is quite substantial; this means—especially if the workpiece coming from the final rolls of the mill travels at a high rate per unit time—that the length of the path portion in which the cooling fluid is subsequently conducted away from the workpiece must also be very long, since otherwise it is impossible to remove all the cooling fluid. Because of this, the known arrangements are not suitable under the special circumstances outlined above, since the duration of contact between the cooling medium and the workpiece is too long to permit the necessary rapid superficially cooling and equally rapid reheating (due to the core heat) of the workpiece surface.

Moreover, the known arrangements do not permit contacting of the workpiece over a substantial length with an adequate quantity of cooling fluid, since large portions of the path travelled by the workpiece are shielded by long workpiece guiding tubes which prevent access of the cooling fluid to the workpiece. Hence, only small and inadequate quantities of cooling fluid can be sprayed onto the workpiece through a nozzle at one end of the respective guide tube—and the thus admitted fluid can moreover be removed only through a few small openings at the other end of the guide tube. Since these bores create a flow resistance for the cooling fluid, they increase the dwell time of the fluid (i.e., the time for which it remains in contact with the workpiece surface). Thus, neither the initial chilling nor the subsequent reheating of the workpiece can take place fast enough to meet the requirements which are made when steel of uniform high quality is to be produced.

Finally, the known arrangements have still a further disadvantage, in that the ends of workpieces (especially wires) travelling through the guide tubes tend to become caught in the bores or slots provided in the guide tubes for evacuation of the cooling fluid. This leads inevitably to malfunctions and consequently to uneconomical machine down-time.

Another prior art arrangement is known from German Pat. DE=PS No. 557,455. Here, the workpieces are guided through a housing which is provided with several annular water-stripping elements. Because of the guidance of the workpieces these elements must be arranged in close succession so that the cooling water can be sprayed only onto short increments of the workpiece surface. Sudden superficially cooling of the workpiece surface over a substantial length of the same is not possible, nor can a uniform superficial cooling of the work surface be obtained by the disclosed spraying action. This arrangement is, therefore, suited for its own specific purpose but not for treating workpieces of the type outlined above, especially since immediately downstream of each of the stripping elements another cooling step takes place so that due to the close spacing of these elements, the requisite reheating of the workpiece from the core heat cannot occur.

In another cooling arrangement which has been proposed for cooling rolled stock including wires, rods and the like, a first end member and a second end member are provided which are longitudinally spaced from one another and which have respective axially aligned passages, a plurality of rods connecting the end members and angularly spaced about the axis of alignment of the passage, the rods having first ends connected to the first end member on a first circle surrounding the passage of the first end member and also having second ends connected to the second end member on a smaller-diameter second circle surrounding the passage of the second end member, so that the space bounded by the bars converges from the first towards the second end member. Means are provided for admitting cooling fluid into contact with a workpiece travelling through the passages, so that the cooling fluid can escape between the bars subsequent to such contact.

This arrangement is highly advantageous, because it permits a rapid outflow of the cooling medium away from the just-contacted workpiece, due to the large interstices between the bars and also due to the circular bar cross-section which offers minimum flow resistance.

It has also been proposed to surround that end region of the bars at which the cooling medium is adjusted with a sleeve or jacket which is concentric to the longitudinal axis of the passage through which the workpiece advances. The cooling medium is to be admitted into this jacket and to flow from there between the bars into contact with the workpiece, whereupon it flows out again between the bars at a location further downstream.

However, in certain applications even this otherwise highly advantageous arrangement still does not offer the desired optimum control over the pressure conditions during contacting of the cooling medium with the workpiece surface.

SUMMARY OF THE INVENTION

Accordingly, it is an object of the invention to provide such desired improvements over the prior art.

More particularly, it is an object of the invention to provide an improved arrangement for the intermittent cooling of workpieces produced by rolling, particularly of wires, rods and the like.

Another object is to provide such a cooling arrangement which makes it possible to bring large quantities of cooling fluid into sudden contact with the workpiece surface over a substantial length of the workpiece, and to guide such cooling fluid away again from the workpiece in the briefest possible time, in order to obtain highly intensive superficial cooling of the workpiece surface and a sudden temperature differential between the same and the workpiece core.

A concomitant object is to provide such an arrangement whose overall required length may be short so that its operation is economical, due to the fact that the required workpiece treatment is effected and completed rapidly.

Still another object is to provide an arrangement of the type in question in which guidance of the workpieces, especially of wires, is so improved that malfunctions resulting from the workpiece being caught in the guiding arrangement, are fully or at least substantially precluded and a central guidance is obtained for the workpieces without requiring lateral support.

An additional object is to provide such an arrangement wherein the cooling medium is supplied in the supply section of the arrangement in a manner assuring more intense cooling than before, while also offering an optimum control and coordination of the pressure conditions, including a directed pressure reduction permitting improved breaking away of the cooling-medium film in the cooling-medium discharging section of the arrangement.

These objects, and still others which will become apparent hereafter, are achieved in an arrangement of the type under discussion, which comprises at least one unit comprising a first end member and a second end member which are longitudinally spaced from one another and which have respective axially aligned passages, a plurality of bars connecting said end members and angularly spaced about the axis of alignment of the passages, the bars having first ends connected to the first end member on a first circle surrounding the passage of the first end member and also having second ends connected to the second end member on a smaller-diameter second circle surrounding the passage of the second end member, so that the space bounded by the bars converges from the first towards the second end member, and admitting means for admitting cooling fluid into contact with a workpiece travelling through the passages and means for allowing the cooling fluid to escape between the bars subsequent to such contact, an improvement wherein the admitting means comprises an admitting element upstream of the first end member and formed with a convergent-divergent guide passage of substantially conical cross-section for the workpiece, as considered in the direction of travel of the same, the divergent part of the guide passage being located upstream of the convergent part thereof, and the fluid inlet means communicating with the guide passage and comprising a first wall bounding the passage and provided at the divergent part with a plurality of circumferentially spaced slot-shaped openings communicating with the divergent part and extending toward the convergent part, and a second wall surrounding the first wall and bounding therewith an annular fluid chamber communicating with the slot-shaped openings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
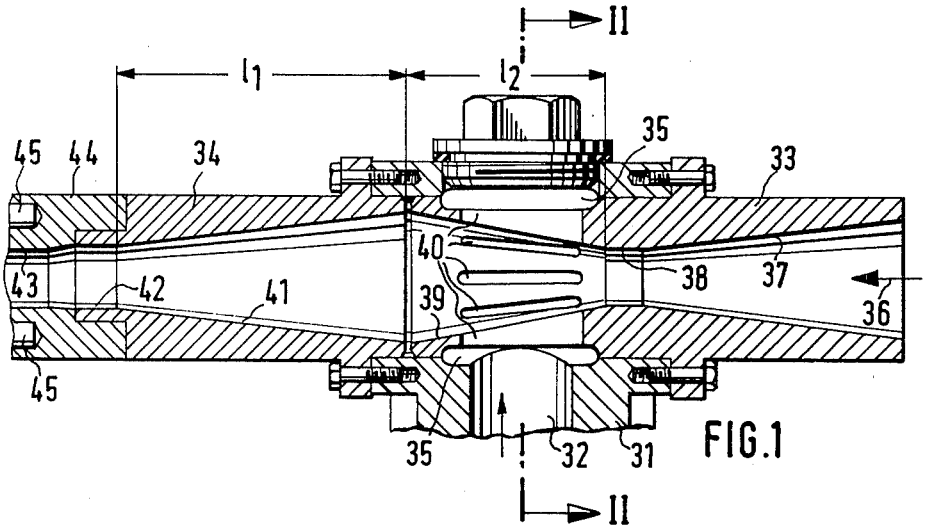
FIG. 1 is an axial section through an arrangement embodying the present invention.
Figure 2:
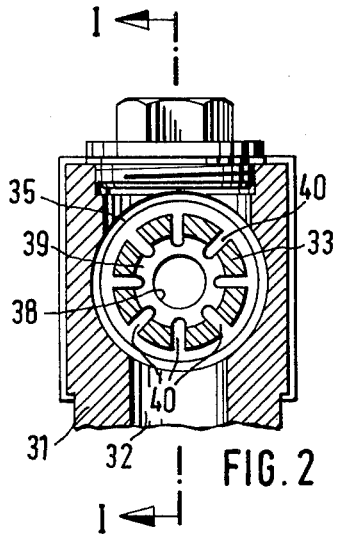
FIG. 2 is a cross-section taken on line II—II of FIG. 1.

The embodiment of FIGS. 1 and 2 has a nozzle body 31 which is provided with an inlet 32 for the cooling fluid, e.g. water. The body 31 also mounts two tubular inserts 33 and 34; the portion of insert 33 which is located in the body 31 defines with the inner circumferential surface of the same an annular cooling-fluid supply chamber with which the inlet 32 communicates. The workpiece is not shown in FIGS. 1 and 2 but will advance through insert 33, body 31 and then insert 34 in the direction of the arrow 36.

To facilitate entry of the workpiece into the insert 33 the same is formed with an inlet passage which converges in downstream direction and reaches its smallest cross-section at 38; from there the passage of insert 33 diverges in section 39 in conical manner and in downstream direction. The wall bounding section 39 is provided with circumferentially distributed slots 40 which are elongated in direction of the arrow 36 and are oriented to discharge cooling fluid towards the longitudinal axis of the section 39 with which the axis of the workpiece will coincide.

Immediately downstream of the end of section 39 there follows a converging section 41 of the insert 34 which reaches its smallest cross-section where it tapers into a cylindrical section 42 of the insert 34. Downstream of the section 42 there is provided a guide channel 43 which is formed in a tubular guide portion 44. As indicated at 45, it is this guide portion which carries the annulus of rods or bars 45 which surrounds the central longitudinal axis of the passage through which the workpiece advances. Thus, the body 31 together with its inserts 33, 34 will be seen to have a passage formed by two successive, coaxial divergent-convergent sections 39, 41 whose largest cross-sections are proximal to one another and to the guide portion 44.

It should be noted that the axial length of the downstream section 41 is longer than the axial length of the upstream section 39, by an amount which is so selected that the pressure of cooling fluid at the inlet end (i.e., at 38) of section 39 is greater than the pressure of cooling fluid at the outlet end (i.e. at 42) of the section 41. It is advantageous if the ratio of the length of section 39 with respect to the length of section 41 is at least approximately 1:1.5. To improve fluid flow conditions the outer edges of the slots 40, i.e., those facing the annular chamber 35, may be rounded or bevelled.

In the embodiment of FIGS. 1 and 2 the contact between the cooling fluid and a large workpiece surface area is particularly intensive and a precise fluid pressure control is obtained within the part of the arrangement which serves for supply of the cooling fluid to the workpiece. Also, fluid flow directed to the workpiece axis is always assured. In particular, the greater fluid pressure at the inlet of the section 39 than at the outlet of the section 41, results in a pressure reduction in the direction of workpiece advancement—and this is desirable because it facilitates the separation of the cooling fluid from the workpiece surface once the fluid reaches the interstices between the bars 45.

Since according to the invention in effect only a single type of arrangement is needed for cooling purposes, manufacturing costs, stock-keeping problems and investment expenses are all significantly reduced. A single type of arrangement permits the construction of highly effective cooling and discharging installations of short overall length for intermittent cooling or chilling and reheating of workpieces. The number of cooling and reheating stages can be selected at will and the overall cost is within economically readily acceptable limits. Thus, the invention permits the desired interval-type pressure cooling which assures the production of steel of uniformly high quality.

The herein disclosed arrangement may also be combined with others known from the prior art (i.e., be arranged upstream or downstream of such others) if it is desirable to obtain (for certain portions of the workpieces being treated with prior-art arrangement) the more intensive intermittent cooling action offered by the inventive arrangement.

Due to the excellent guidance afforded the workpieces by the inventive arrangement, there is no danger that the workpieces might contact the wall of the arrangement and thus become non-uniformly cooled. Cooling fluid to uniform temperature and turbulence can always reach the entire surface of a long section workpiece in great quantity and can very rapidly be removed again from the surface of the workpiece, so that uniform intermittent or chilling and reheating of the workpiece surface is assured.

The arrangement according to the invention, as exemplified in FIGS. 1 and 2, can be used with devices of the type proposed in the prior art. Several of said devices will be discussed hereafter, for purposes of a better understanding of the invention and of its range of applications.

Figure 3:
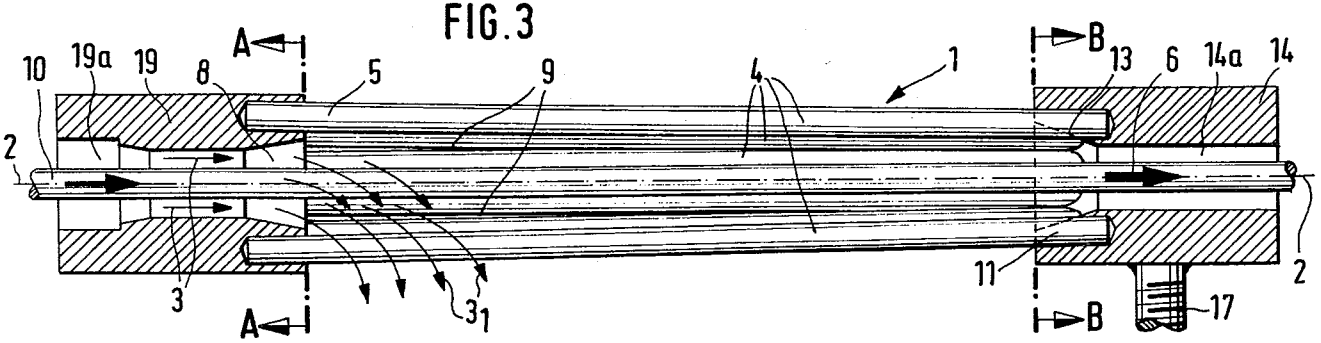
FIG. 3 is a longitudinal section through a device with which the arrangement according to the invention can be used.
Figure 4:
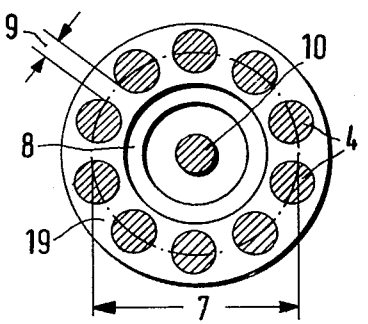
FIG. 4 is a section on line A—A of FIG. 3.
Figure 5:
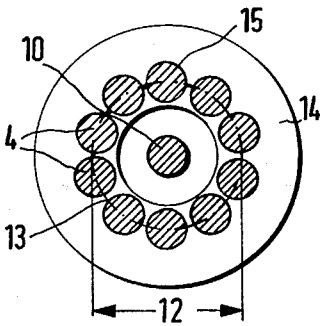
FIG. 5 is a section on line B—B of FIG. 3.

One such device is illustrated in FIGS. 3–5. Its purpose is to cool a workpiece 10 (e.g. a wire, bar or the like) which travels from a source (e.g., a not illustrated rolling mill) in direction of the arrow 6 through the arrangement according to the present invention.

The arrangement is designated with reference numeral 1 and has an inlet section 19 and an outlet section 14. The inlet section 19 has a passage **19*a* through which the workpiece 10 travels and which merges at its downstream end into a nozzle 8 of diverging cross-section. Similarly, the outlet section 14 has at its upstream end an inlet nozzle 13 which converges in downstream direction and merges with a passage 14*a*. The central axes 2 of the sections 19 and 14 are aligned and coincide with the axis of the workpiece 10**.

Sections 19 and 14 are connected by a plurality of longitudinally extending rods or bars 4 which in this embodiment are of circular cross-section (see FIGS. 4 and 5). The upstream ends 5 of the rods 4 are secured in the section 19 (e.g., by welding, threading or the like) and located on a circle 7 (FIG. 4) which surrounds the nozzle 8 and is concentric to the axis 2. The downstream ends 11 of the rods 4 are similarly secured to the section 14 and are located on a circle 12 (FIG. 5) which surrounds the nozzle 13 and is also concentric to the axis 2. However, the diameter of the circle 12 is smaller than the diameter of the circle 7 so that the cross-section of the passage which is surrounded and defined by the rods 4 converge in direction from the section 19 towards the section 14.

Because of this, the spacing between circumferentially adjacent ones of the rods 4 is greatest adjacent the downstream end of the nozzle 8 of the section 19. Cooling medium 3 is admitted in large quantities of the upstream end of the passage **19*a* about the workpiece 3 and travels in direction of the straight arrows. Since the nozzle 8 diverges in downstream direction and is immediately followed by the widest spacing between the rods 4, this cooling medium (now designated by the curved arrows $3_1$) can flow very rapidly out between the rods 4, so that contact between it and the workpiece is terminated abruptly. Flow retardation is avoided since the circular cross-section 15 of the rods 4** offers little if any obstruction.

The number of rods 4 may be selected more or less freely, with the proviso that the maximum spacing 9 (FIG. 4) between adjacent rods should be smaller than the cross-section of the workpiece 10, so that the latter cannot become caught in the interstices between the rods.

The section 14 is provided with a mounting member 17 of any suitable type, to permit the arrangement to be mounted in desired positions. It is advantageous if the diameter of the circle 12 equals or substantially equals the largest diameter of the inlet nozzle 13, so that half or about half of the cross-section of each rod 4 is located radially inwardly of this largest diameter (FIG. 5). This facilitates entry of the leading end of the respective workpiece 10 into the nozzle 13 and assures low-friction and trouble-free movement of the workpieces through the section 14.

Figure 6:
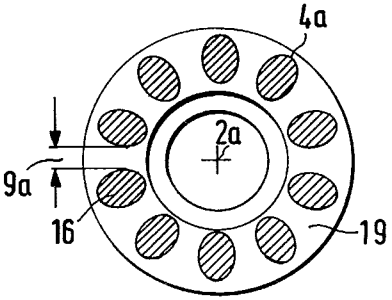
FIG. 6 is a sectional view similar to FIG. 4 but showing a different device with which the invention can be used.

The resistance to outflow of the cooling fluid $3_1$ (out of contact with the workpiece 10) can be still further reduced if, as shown in FIG. 6, which is otherwise identical with FIGS. 3–5, the rods **4*a* have an oval or elliptical cross-section 16. If the rods 4*a* are so mounted that the major axis of each ellipsis extends radially of the central axis 2*a*, a maximum outflow gap 9*a* for the cooling fluid can be obtained without in any way disadvantageously influencing the guidance of the workpieces 10**.

While the invention has been illustrated and described as embodied in a cooling arrangement for rolled stock it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. In a cooling arrangement, particularly for cooling rolled stock including wires, rods and the like, having at least one unit comprising a first end member and a second end member which are longitudinally spaced from one another and which have respective axially aligned passages, a plurality of bars connecting said end members and angularly spaced about the axis of alignment of said passages, said bars having first ends connected to said first end member on a first circle surrounding the passage of said first end member and also having second ends connected to said second end member on a smaller-diameter second circle surrounding the passage of said second end member, so that the space bounded by said bars converges from said first towards said second end member, and admitting means for admitting cooling fluid into contact with a workpiece travelling through said passages, and means for allowing the cooling fluid to escape between said bars subsequent to such contact, an improvement wherein said admitting means comprises an admitting element upstream of said first end member and formed with a convergent-divergent guide passage of substantially conical cross-section for the workpiece, as considered in the direction of travel of the same, the divergent part of said guide passage being located upstream of the convergent part thereof; and said fluid inlet means communicating with said guide passage and comprising a first wall bounding said passage and provided at said divergent part with a plurality of circumferentially spaced slot-shaped openings communicating with said divergent part and extending toward said convergent part, and a second wall surrounding said first wall and bounding therewith an annular fluid chamber communicating with said slot-shaped openings.

2. A cooling arrangement as defined in claim 1, wherein the convergent part has an axial length which is greater than the axial length of said divergent part so that the pressure of cooling fluid at an upstream end of said divergent part is greater than the pressure of the cooling fluid at a downstream end of said convergent part.

3. A cooling arrangement as defined in claim 2, wherein the ratio of the axial length of said divergent part relative to the axial length of said convergent part is at least substantially equal to 1:1.5.

4. A cooling arrangement as defined in claim 1, wherein said slot-shaped openings have outer ends communicating with said annular fluid chamber and bounded by edges which are rounded.

5. A cooling arrangement as defined in claim 1, wherein said slot-shaped openings have outer ends communicating with said annular fluid chamber and bounded by edges which are bevelled.

* * * * *